US005497878A

United States Patent [19]

Sandonato

[11] Patent Number: 5,497,878

[45] Date of Patent: Mar. 12, 1996

[54] WORK SURFACE EXTENSIONS FOR TOOL STORAGE UNITS

[76] Inventor: Henry L. Sandonato, 741 Hillview Ct., Lewiston, N.Y. 14092

[21] Appl. No.: 314,042

[22] Filed: Sep. 27, 1994

[51] Int. Cl.[6] ..... B65D 85/28; A47B 77/10

[52] U.S. Cl. ..... 206/372; 206/373; 312/281; 312/282; 312/313

[58] Field of Search ..... 206/372, 373; 312/280, 281, 282, 313, 902

[56] References Cited

U.S. PATENT DOCUMENTS

| | | | |
|---|---|---|---|
| 468,929 | 2/1892 | Cochrane | 312/282 |
| 562,727 | 6/1896 | Hooper | 312/280 |
| 1,300,759 | 4/1919 | Nielsen | 312/281 |
| 1,696,683 | 12/1928 | Kieffer et al. | 312/282 |
| 2,156,776 | 5/1939 | Drover | 312/282 |
| 2,244,036 | 6/1941 | Williman et al. | 312/313 |
| 2,535,112 | 12/1950 | Woody | 312/282 |
| 4,120,549 | 10/1978 | Bureau | 312/281 |
| 5,160,026 | 11/1992 | Marsh | 206/373 |

*Primary Examiner*—Paul T. Sewell
*Assistant Examiner*—Marie Denise Patterson

[57] ABSTRACT

Work surface extensions for tool storage units comprising a horizontally disposed housing adapted to be located between a pair of tool boxes, the housing being of a rectangular configuration positionable in a generally horizontal plane with a periphery generally corresponding to the periphery of adjacent tool boxes above and below, a pair of apertures, one on each side of the housing, the apertures being located at varying elevations with respect to each other, with a chamber formed within the housing and being accessible through the apertures and a pair of reciprocable members, the reciprocable members being of a planar configuration in the form of rectangles, each of the members being positioned through one of the apertures, each of the members having a first work surface on one side and a second work surface on the other side, each reciprocable member movable in a generally horizontal plane between an extended orientation wherein the majority of the work surface is exterior of the housing extending through its associated aperture and a retracted orientation where the majority of the housing is located within the chamber with a portion thereof extending exterior of the chamber.

3 Claims, 4 Drawing Sheets

22
4
4
30
34
26
5
5

42
30
48
40
46
44
36
24

WORK SURFACE EXTENSIONS FOR TOOL STORAGE UNITS

BACKGROUND OF THE INVENTION

Field of the Invention

The present invention relates to work surface extensions for tool storage units and more particularly pertains to providing additional work surfaces for use in association with existing tool boxes.

Description of the Prior Art

The use of tool boxes and associated work surfaces is known in the prior art. More specifically, tool boxes and associated work surfaces heretofore devised and utilized for the purpose of providing additional work surfaces as part of an existing tool box are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,522,326 a rolling tool box serving to prevent a truck owner or user from climbing in and out of the truck for tools.

U.S. Pat. No. 5,083,664 discloses a multi-storied tool box capable of neatly storing therein a great number of tools and having a first tool box and a second tool box.

U.S. Pat. No. 5,088,636 discloses a rolling tool box which is slidable mounted and supported between channels installed on opposite side walls of a pickup truck bed such that it will move between a stored position at the forward end and a tailgate rear end of the truck bed.

U.S. Pat. No. 5,114,007 discloses a first and second casing halves of a tool box with an inner wall provided with at least one tool-receiving recess.

U.S. Pat. No. Des. 307,967 discloses an ornamental design for the tool box tray.

In this respect, the work surface extensions for tool storage units according to the present invention substantially departs from the conventional concepts and designs of the prior art, and in doing so provides an apparatus primarily developed for the purpose of providing additional work surfaces for use in association with existing tool boxes.

Therefore, it can be appreciated that there exists a continuing need for new and improved work surface extensions for tool storage units which can be used for providing additional work surfaces for use in association with existing tool boxes. In this regard, the present invention substantially fulfills this need.

SUMMARY OF THE INVENTION

In view of the foregoing disadvantages inherent in the known types of tool boxes and associated work surfaces now present in the prior art, the present invention provides an improved work surface extensions for tool storage units. As such, the general purpose of the present invention, which will be described subsequently in greater detail, is to provide new and improved work surface extensions for tool storage units and method which has all the advantages of the prior art and none of the disadvantages.

To attain this, the present invention essentially comprises a new and improved work surface extension for tool storage units comprising, in combination, a horizontally disposed housing adapted to be located between a pair of tool boxes, the housing being of a rectangular configuration positionable in a generally horizontal plane with a periphery generally corresponding to the periphery of adjacent tool boxes above and below, a pair of apertures, one on each side of the housing, the apertures being located at varying elevations with respect to each other, with a chamber formed within the housing and being accessible through the apertures, a pair of reciprocable members, the reciprocable members being of a planar configuration in the form of rectangles, each of the members being positioned through one of the apertures, each of the members having a first work surface on one side and a second work surface on the other side, each reciprocable member movable in a generally horizontal plane between an extended orientation wherein the majority of the work surface is exterior of the housing extending through its associated aperture and a retracted orientation where the majority of the housing is located within the chamber with a portion thereof extending exterior of the chamber, a locking bracket formed within each member adjacent to its interior edge, the locking member adapted to slide with its associated member, the locking component adapted to be reciprocated transverse to the direction of movement to allow separation of the member from the housing for effecting the reciprocation thereof, at least one of the reciprocable members being formed with a first surface and a pivotable second surface secured to the first surface through a hinge with an associated bracket adapted to hold the second surface at an angle with respect to the first surface as for writing and a brace pivotally secured to a point beneath one member and having an upper end adapt to be secured to the exterior end of the member, the brace being of a linear configuration with telescopic sections and a thumb screw to vary the length thereof and an associated clip to hold the brace in a vertical orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved work surface extensions for tool storage units which have all the advantages of the prior art tool boxes and associated work surfaces and none of the disadvantages.

It is another object of the present invention to provide new and improved work surface extensions for tool storage units which may be easily and efficiently manufactured and marketed.

It is further object of the present invention to provide new and improved work surface extensions for tool storage units which are of durable and reliable constructions.

An even further object of the present invention is to provide new and improved work surface extensions for tool storage units which are susceptible of a low cost of manufacture with regard to both materials and labor, and which accordingly are then susceptible of low prices of sale to the consuming public, thereby making such work surface extensions for tool storage units economically available to the buying public.

Still yet another object of the present invention is to provide new and improved work surface extensions for tool storage units which provide in the apparatuses and methods of the prior art some of the advantages thereof, while simultaneously overcoming some of the disadvantages normally associated therewith.

Still another object of the present invention is to provide additional work surfaces for use in association with existing tool boxes.

Lastly, it is an object of the present invention to provide new and improved work surface extensions for tool storage units comprising a horizontally disposed housing adapted to be located between a pair of tool boxes, the housing being of a rectangular configuration positionable in a generally horizontal plane with a periphery generally corresponding to the periphery of adjacent tool boxes above and below, a pair of apertures, one on each side of the housing, the apertures being located at varying elevations with respect to each other, with a chamber formed within the housing and being accessible through the apertures and a pair of reciprocable members, the reciprocable members being of a planar configuration in the form of rectangles, each of the members being positioned through one of the apertures, each of the members having a first work surface on one side and a second work surface on the other side, each reciprocable member movable in a generally horizontal plane between an extended orientation wherein the majority of the work surface is exterior of the housing extending through its associated aperture and a retracted orientation where the majority of the housing is located within the chamber with a portion thereof extending exterior of the chamber.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
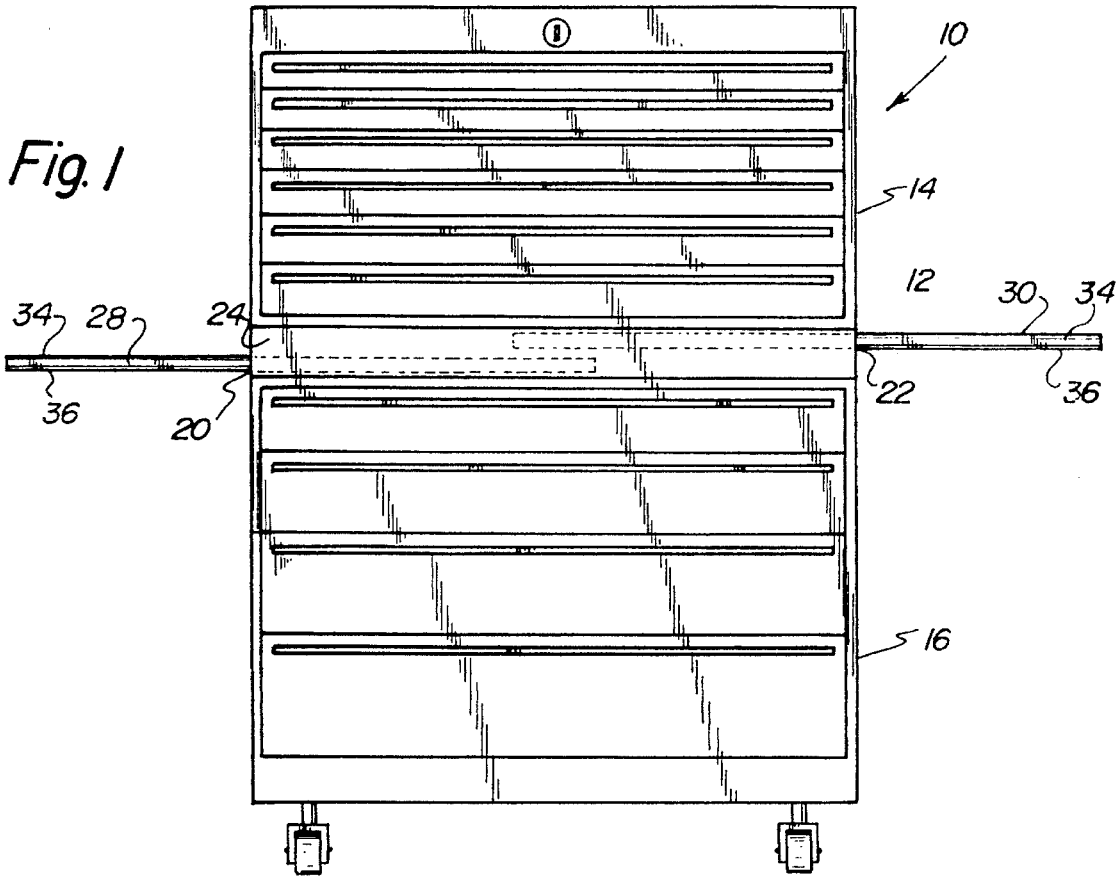
FIG. 1 is a front elevational view of the preferred embodiment of the new and improved work surface extension for tool storage units constructed in accordance with the principles of the present invention.
Figure 2:
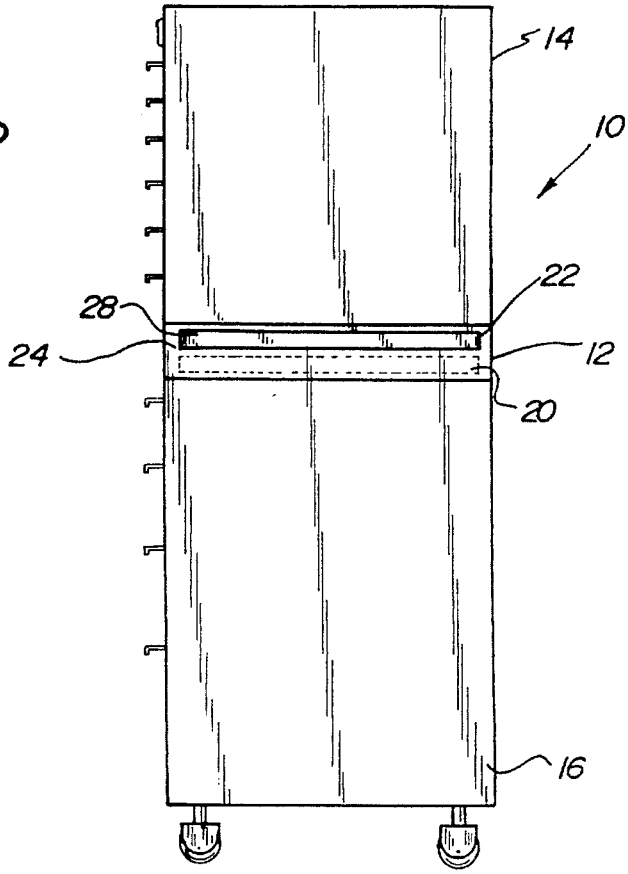
FIG. 2 is a side elevational view of the device shown in FIG. 1.
Figure 3:
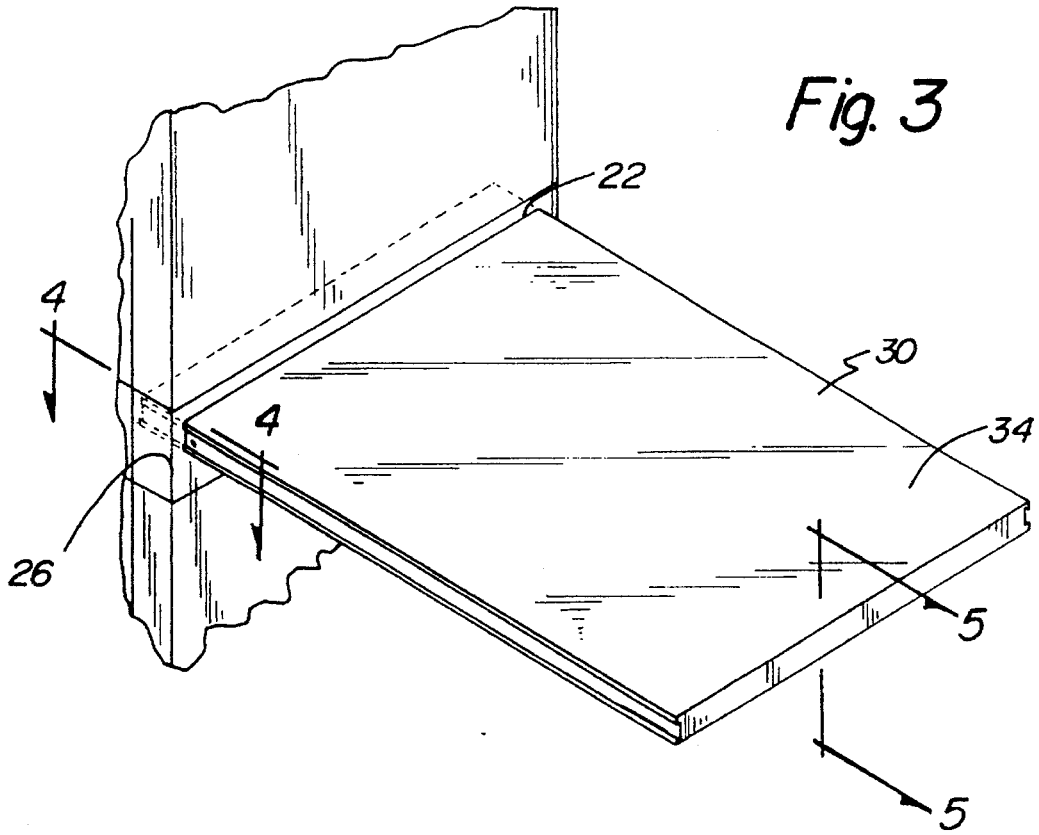
FIG. 3 is an enlarged-perspective view of the additional work surface in an extended orientation.

With reference now to the drawings, and in particular to FIG. 1 thereof, the preferred embodiment of the new and improved work surface extensions for tool storage units embodying the principles and concepts of the present invention and generally designated by the reference numeral 10 will be described.

The present invention, new and improved work surface extensions for tool storage units, may be construed as a system 10. In the broadest context, the system includes a housing, apertures and reciprocal members. Also included are a locking bracket and, in alternate embodiments, a pivotable second surface as well as a brace for the reciprocable members. Such components are individually configured and then correlated one with respect to the other to attain the desired objective.

More specifically, the device has for its central component a horizontally disposed housing 12. The housing 12 is adapted to be located between a pair of tool boxes 14 and 16. The housing 12 is of a generally rectangular configuration with a rectangular planar upper surface adapted to support an upper tool box and with a generally planar rectangular lower surface adapted to be supported on a lower tool box. The periphery of the housing 12 including its upper and lower surfaces generally correspond to the periphery of the adjacent tool boxes above and below.

The housing 12 is provided with a pair of apertures 20 and 22. One aperture is one each side of the housing 12. The apertures are located at varying elevations with respect to each other. One such aperture is totally above the other aperture. A chamber 24 is thus formed within the housing 12, the chamber 24 being entirely within the housing 12. The chamber 24 is accessible from exterior through the apertures. Supporting rails 26 are provided for support of reciprocal members when within the chamber 24.

Next provided are a pair of reciprocal members 28 and 30. Such members are of a similar construction. Each is in a planar configuration in the form of a rectangle. Each member is positionable through one of its apertures, an associated aperture.

Each of such members has a first work surface 34 on one side, the upper side and a second work surface 36 on the other or lower side. For operation and use, each reciprocal member is movable in a generally horizontal plane being in extended orientation when the majority of the work surface is exterior of the housing 12 extending through its associated aperture in a retracted orientation where the majority of the housing is located within the chamber 24 with only a portion thereof extending exterior of the chamber 24 so that it may be grasped for pulling it out to an operational position.

Figure 4:
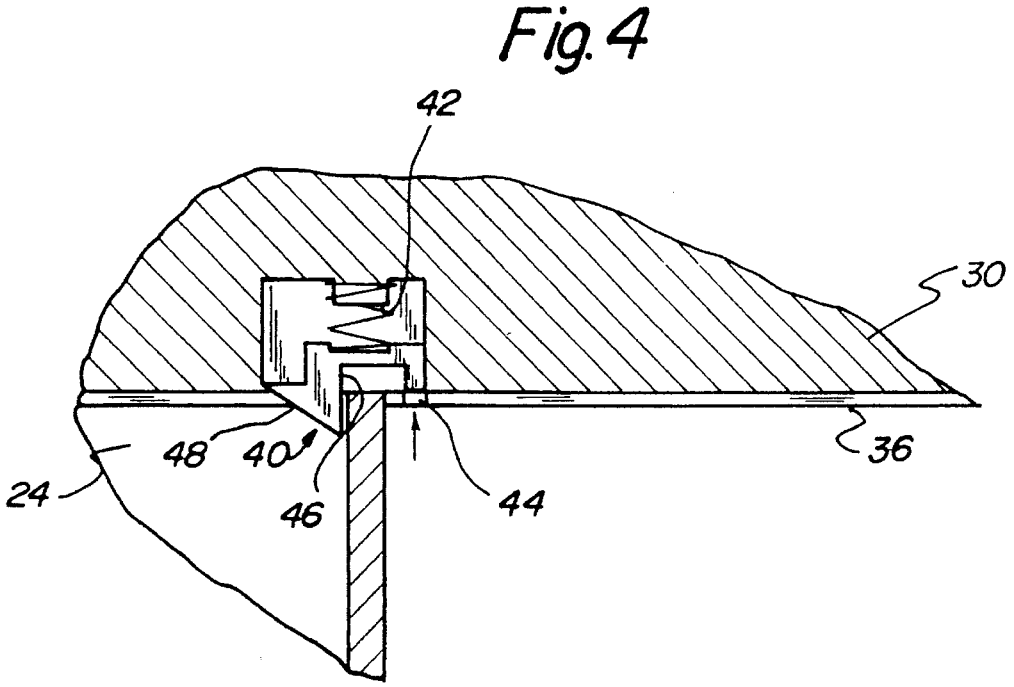
FIG. 4 is a cross-sectional view taken along lines 4—4 of FIG. 3.

In order to hold the reciprocal members in their operative orientation, and to preclude them from being pulled totally from the housing inadvertantly, a locking bracket 40 is provided. Such locking bracket 40 is formed with a member adapted to slide vertically within a recess of the reciprocable member. A spring 42 tends to hold the locking bracket 40 down. As can be seen in FIG. 4, a small hole 44 is formed in the lower surface of the reciprocable member adjacent to the bracket. When the reciprocable member is in the extended operative position as shown in FIG. 4, a vertical surface 46 precludes the reciprocable member from being pulled excessively far, totally outside of the chamber 24. By pushing a nail or other thin rigid through the hole in the bottom of the reciprocable member, the bracket may be pushed upwardly so that the reciprocable member is not pulled out excessively. The rear face of the locking bracket is in the form of a angled wedge 48 to allow the bracket and drawer to be placed in position when so desired.

Figure 5:
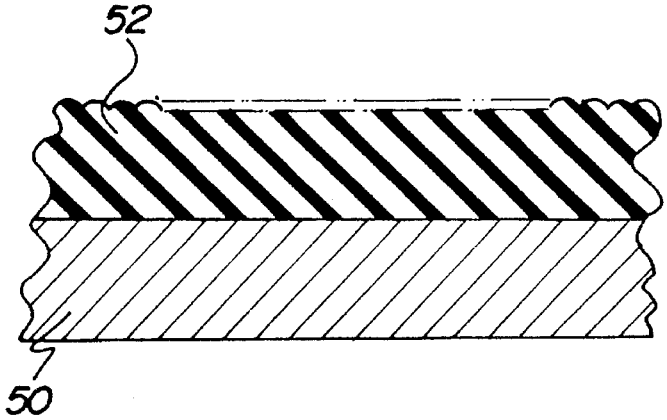
FIG. 5 is a cross-sectional view taken along lines 5—5 of FIG. 3.

FIG. 5 illustrates an alternate embodiment of the invention. In this embodiment, the reciprocable member is formed as a laminate. More specifically, one side 50 of the reciprocable member is of metal for normal use in a tool room. The opposite side 52 is formed of rubber as may be required during certain carpentry or machine operation.

Figure 6:
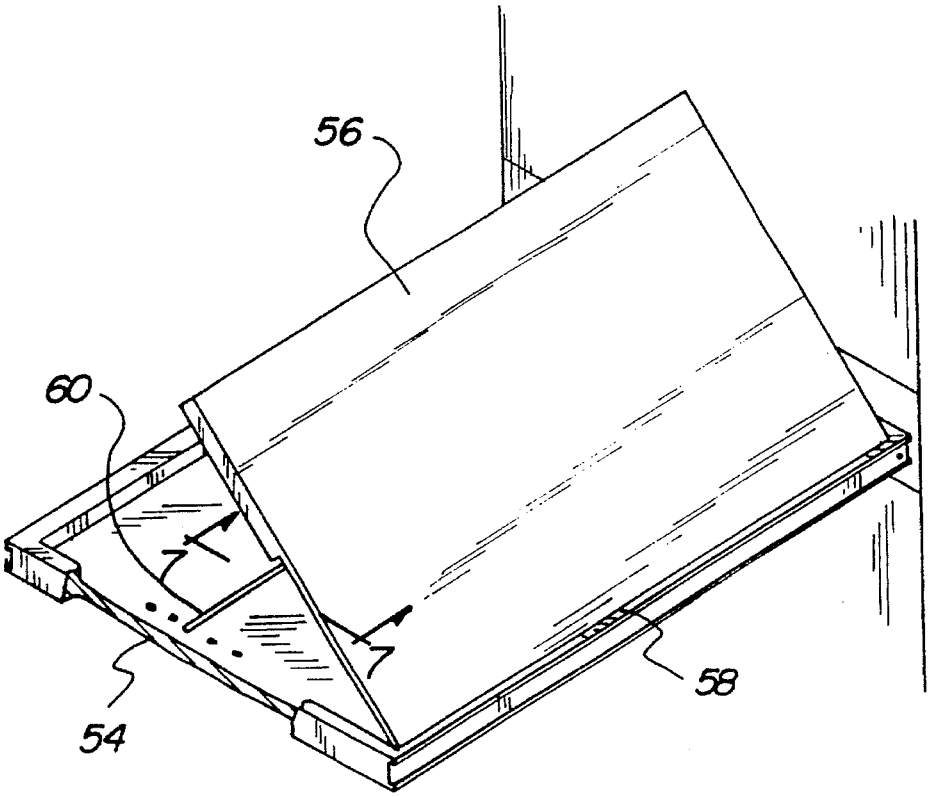
FIG. 6 is a perspective view of an alternate embodiment of the invention.
Figure 7:
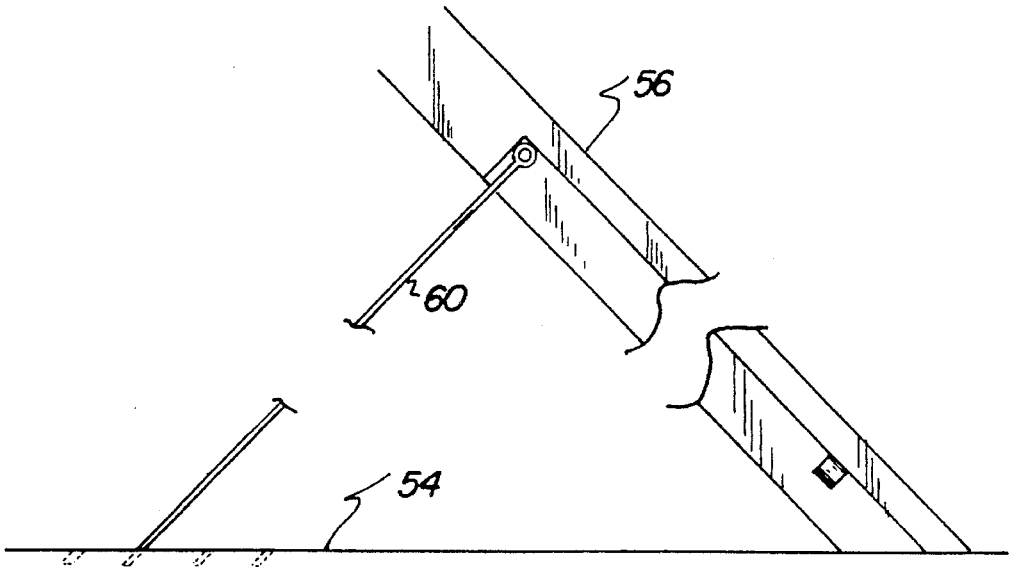
FIG. 7 is a cross-sectional view taken along lines 7—7 of FIG. 6.

FIGS. 6 and 7 illustrate yet a further embodiment of the invention. In this embodiment, one of the reciprocable members is formed of two components, a lower surface 54 and an upper surface 56. Such surfaces are coupled at one end through a hinge 58. A support rod 60 is adapted to be positioned between such surfaces to hold one of the surfaces at an angle as for writing.

Figure 8:
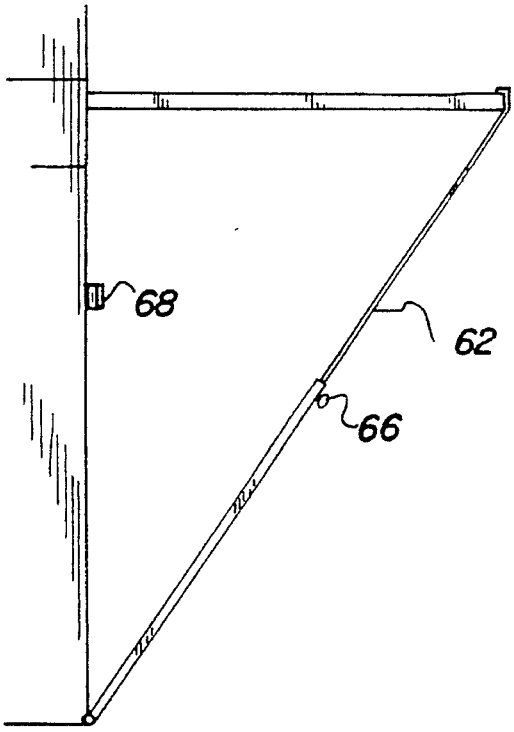
FIG. 8 is a side elevational view of yet another alternate embodiment of the invention.

The last embodiment is shown in FIG. 8. In such embodiment, a brace 62 is pivotably secured at a point beneath one member. It has an upper end 64 adapted to be secured to the exterior end of the reciprocable member. The support brace 62 is pivotably secured at a point beneath the associated aperture. The brace 62 is of a linear configuration with telescoping sections and a thumb screw 66. This allows the varying of the length of the brace to thereby hold the brace 62 with greater rigidity in the intended vertical orientation. An associated clip 68 is adapted to hold the brace 62 vertically when not in use for supporting a reciprocable member.

The work surface extension for tool storage units has been devised to provide a practical additional work surface for workers who use heavy duty tool chests with multiple drawers. Present pull-out work surfaces present a few drawbacks. Firstly, these consist basically of a converted drawer for the work surface, thereby reducing overall storage space, and secondly, they slide out to the front, which impedes the access and view to the drawer below. The present invention consists of a pair of flat shelves that slide out to the sides of the tool chest. They fit into the gap created by stacking a smaller tool chest on top of a larger, floor-standing model. It can also be attached directly to the top of the bottom unit. Each work surface extension shelf is cantilevered, using the cumulative weight of the tool chest and its contents for support. Built-in stops prevent accidental complete withdrawal of the work surface extension shelves.

The work surfaces themselves can be constructed with a variety of surface materials, ranging from ribbed rubber to metal to a veneer or formica surface. The individual shelves can be constructed with different work surfaces on the top and bottom. A stop release would allow the shelves to be removed and flipped over to turn the desired work surface face up. Another possibility is a support rod that could be attached to the side of the tool chest at the bottom. Other alternative features include a top layer which can be tilted upward to form a slightly inclined desk surface, or a small flange at the back which can be flipped up to a vertical position to prevent tools and parts from rolling or sliding off the back.

A typical size for the housing or sleeve of the present invention might be 54¼ inches long, about 21½ inches wide, and 5 inches high. The two opposing work surface shelves would be 54¼ inches long, 19 inches wide, and ½ inch thick. The two shelves are positioned at different levels, one being on the bottom and the other on top so that both will fit into the housing. Friction runners or heavy duty ball bearing slides, similar to those used for the drawers in currently available tool chests, may be incorporated.

The present invention is designed to be used with existing tool chests. It can be mounted on a floor-standing unit, and a smaller unit can be stacked on top of the work surface extension housing, if desired. The individual work surface shelves can be pulled out as needed. Because they are on the sides, rather than the front, they do not interfere with use of the lower drawers, yet they are every bit as handy as the front drawer design.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved work surface extension in combination with a pair of tool storage units comprising, in combination:

a horizontally disposed housing positionable between a pair of existing tool boxes, the housing being of a rectangular configuration positionable in a generally horizontal plane with a periphery generally corresponding to the periphery of adjacent existing tool boxes above and below;

a pair of apertures on opposing sides of the housing, the apertures being located at varying elevations with respect to each other, with a chamber formed within the housing;

a pair of reciprocable members, the reciprocable members being of a planar configuration in the form of rectangles, each of the members being positioned through one of the apertures, each of the members having a first work surface on one side and a second work surface on the other side;

a locking bracket formed within each member adjacent to its interior edge;

at least one of the reciprocable members being formed with a first surface and a pivotable second surface secured to the first surface through a hinge with an associated bracket securing the second surface at an angle with respect to the first surface as for writing; and a brace pivotally secured to a point beneath one member and having an upper end secured to the exterior end of the member, the brace being of a linear configuration with telescopic sections and a thumb screw to vary the length thereof and an associated clip to hold the brace in a vertical orientation.

2. A work surface extension in combination with a pair of tool storage units comprising:

a horizontally disposed housing positionable between a pair of existing tool boxes, the housing being of a rectangular configuration positionable in a generally horizontal plane with a periphery generally corresponding to the periphery of adjacent existing tool boxes above and below;

a pair of apertures on opposing sides of the housing, the apertures being located at varying elevations with respect to each other, with a chamber formed within the housing;

a pair of reciprocable members, the reciprocable members being of a planar configuration in the form of rectangles, each of the members being positioned through one of the apertures, each of the members having a first work surface on one side and a second work surface on the other side; and at least one of the reciprocable members being formed with a first surface and a pivotable second surface secured to the first surface through a hinge with an associated bracket securing the second surface at an angle with respect to the first surface as for writing.

3. The housing as set forth in claim 2 and further including:

a brace pivotally secured to a point beneath one member and having an upper end secured to the exterior end of the member, the brace being of a linear configuration with telescopic sections and a thumb screw to vary the length thereof and an associated clip to hold the brace in a vertical orientation.

* * * * *